United States Patent [19]

Wang

[11] 4,295,111

[45] Oct. 13, 1981

[54] LOW TEMPERATURE LATCHING SOLENOID

[76] Inventor: Robert A. Frosch, Administrator of the National Aeronautics and Space Administration, with respect to an invention of William S. Wang, Marina del Rey, Calif.

[21] Appl. No.: 98,568

[22] Filed: Nov. 29, 1979

[51] Int. Cl.[3] ..... H01F 3/00; H01F 7/08

[52] U.S. Cl. ..... 335/256; 335/266; 361/141

[58] Field of Search ..... 335/256, 254, 266, 234; 361/140, 141

[56] References Cited

U.S. PATENT DOCUMENTS

| | | | |
|---|---|---|---|
| 3,022,450 | 2/1962 | Chase, Jr. | 335/256 |
| 3,502,946 | 3/1970 | Kimura | 361/141 |
| 3,843,945 | 10/1974 | Koning | 361/140 |

FOREIGN PATENT DOCUMENTS

| | | | |
|---|---|---|---|
| 205337 | 9/1957 | Australia | 361/140 |

*Primary Examiner*—Harold Broome
*Attorney, Agent, or Firm*—Russell E. Schlorff; John R. Manning; Marvin F. Matthews

[57] ABSTRACT

Disclosed is a magnetically latching solenoid including a pull-in coil and a delatching coil. Each of the coils is constructed with a combination of wire materials, including material of low temperature coefficient of resistivity to enable the solenoid to be operated at cryogenic temperatures while maintaining sufficient coil resistance. An armature is spring-biased toward a first position, that may extend beyond the field of force of a permanent magnet. When voltage is temporarily applied across the pull-in magnet, the induced electromagnetic forces overcomes the spring force and pulls the armature to a second position within the field of the permanent magnet, which latches the armature in the pulled-in position. Application of voltage across the delatching coil induces electromagnetic force which at least partially temporarily nullifies the field of the permanent magnet at the armature, thereby delatching the armature and allowing the spring to move the armature to the first position.

12 Claims, 4 Drawing Figures

LOW TEMPERATURE LATCHING SOLENOID

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; 45 U.S.C. 2457).

BACKGROUND OF THE INVENTION

1. Field of the Invention

The present invention pertains to magnetically-operable control mechanisms. More specifically, the present invention relates to solenoid actuators for operating switches, valves, indicators, and the like, particularly where such devices are to be moved between one configuration and another. The present invention finds particular application in low temperature environments, for operating valves to control flow of cryogenic fluids, for example.

2. Description of Prior Art

Solenoid devices are known for selectively moving control plungers or arms to operate switches or valves in the manner of relays. A solenoid electromagnet is used to establish a magnetic field to so move the plunger or arm in one direction. In a magnetically latching solenoid an oppositely-directed magnetic field may be used to permit the return of the control mechanism to its former position. A mechanical device, such as a biasing spring, may serve to so move the control device toward its former position.

Mechanical latching mechanisms may be employed to lock the control device in position after it has been moved by an electromagnet. However, such mechanical latches may include moving parts which tends to decrease the reliability of the solenoid device. U.S. Pat. No. 3,040,217 discloses a two-position electromagnetic actuator which employs a pair of ring permanent magnets as latching devices.

U.S. Pat. No. 3,699,486 describes a relay for operation over a wide range of temperatures. Electromagnetic devices are limited in operation at cryogenic temperatures, if the resistance of their coil wiring becomes superconducting. Even if the voltage is reduced to a very low, though non-zero value, the coil circuit may draw excessive current.

SUMMARY OF THE INVENTION

The present invention provides magnetically operable apparatus, including a plunger, or armature, comprising magnetically responsive material and movable generally along a path between a first position and a second position. A solenoid coil assembly generally circumscribes the path and is positioned so that the center of the plunger moves generally toward the center of the coil as the plunger moves from the first position to the second position. The coil includes a first coil segment constructed of electrically conducting material, and a second coil segment electrically connected in series with the first coil segment. The second coil segment is constructed of electrically conducting material having a temperature coefficient of resistivity lower than that of the material of the first coil segment. In particular, the first and second coil segments are constructed so that the total resistance of the coil remains non-zero for all values of the temperature of the environment within which the apparatus is to be operated.

By selectively connecting a source of electrical power across the ends of the coil, electrical current may be made to flow in one direction or the other through the coil. Thus, a solenoid magnetic field may be generated with the direction of the field along the path selected in one sense or the other.

A magnetic latching device, such as a permanent magnet, may be provided to hold the plunger in the second position. Then, an electromagnetic field generated by an electrical current flowing through the coil in the appropriate direction may be utilized to move the plunger from the first position to the second position. Current through the coil may then be interrupted, and the latching means utilized to maintain the plunger in the second position. To move the plunger from the second position to the first position, current may be produced in the coil in the opposite sense to establish a magnetic field to overcome the effect of the magnetic latching device. Then, a biasing apparatus, such as a coil spring, may be utilized to move the plunger toward the first position.

In a particular embodiment shown, a coil assembly includes two coil subassemblies positioned so that either coil subassembly may be utilized to generate a solenoid magnetic field passing through at least a portion of a plunger or armature constructed of magnetically responsive material. Each of the coil subassemblies includes two coiled wire segments. In the case of each coil subassembly, one of the coiled wire segments is constructed of material exhibiting a relatively low temperature coefficient of resistivity. The other coiled wire segment of the coil subassembly in each case is constructed of relatively good electrical conducting material. In the case of each coil subassembly, the relative lengths of the coiled wire segments are chosen to ensure that the total resistance of the two coiled wire segments arranged in series remains above a preselected value as the temperature of the apparatus is reduced to a lower limit. Consequently, electrical power may be provided from a power source to selectively produce electrical currents within the coil subassemblies without drawing excessive current from the power supply, even at cyrogenic temperatures.

A permanent ring magnet is provided to establish a magnetic field of generally solenoid shape such that the longitudinal axis of the field of the permanent ring magnet and of the two coil subassemblies are generally aligned.

The armature is constrained to move along a line between a first extreme position and a second extreme position generally toward the centers of the aforementioned magnetic fields. A spring, such as a coil spring, is positioned to bias the plunger toward the first position. The strength of the permanent magnet field and the force constant of the spring are selected so that the permanent magnet is incapable of drawing the armature toward the second position in opposition to the biasing of the spring. However, once the armature is in the second position, the field of the permanent magnet is sufficiently strong to maintain the armature in the second position. The permanent magnet thus acts as a magnetic latching means to latch the armature in the second position. The number of turns in the two coil subassemblies are chosen, in conjunction with the power source, to provide sufficient ampere-turns with one coil subassembly to generate a magnetic force acting on the armature to overcome the spring biasing to move the armature from the first position to the second position, and, with the other coil subassembly, to generate sufficient magnetic field strength at the armature in the second position to sufficiently nullify the effect of the permanent magnet to allow the spring to move the armature from the second position to the first position. Also, the strength of the magnetic field produced by the second coil assembly to so nullify the effect of the permanent magnet is yet sufficiently small to avoid diminishing the strength of the permanent magnet. The first coil subassembly, in pulling the armature toward the second position against the action of the spring, thus operates as a "pull-in" coil; the second coil subassembly which permits the spring to move the armature against the effect of the permanent magnet, thus operates as a "delatching" coil.

In an alternative embodiment shown, a coil assembly is constructed of two coiled wire segments, one of good conducting material and the other of material exhibiting a relatively low temperature coefficient of resistivity. The coil assembly is then utilized in conjunction with a power supply and appropriate switching apparatus to function both as a pull-in coil and as a delatching coil by simply selecting the direction of current flow in the coil assembly to generate a magnetic field in the desired direction in the vicinity of the armature. If necessary, the power applied to the coil assembly may be adjusted to ensure that the strength of the permanent magnet used as the latching means is not diminished in the delatching mode of operation.

The present invention provides a magnetically latching solenoid which is operable at extreme low temperatures, and over a substantially broad temperature range without the need for adjusting the power applied to the solenoid to accommodate changes in resistance of the solenoid coil assembly with varying temperature. Additionally, no mechanical latching devices are employed.

DESCRIPTION OF PREFERRED EMBODIMENTS

Figure 1:
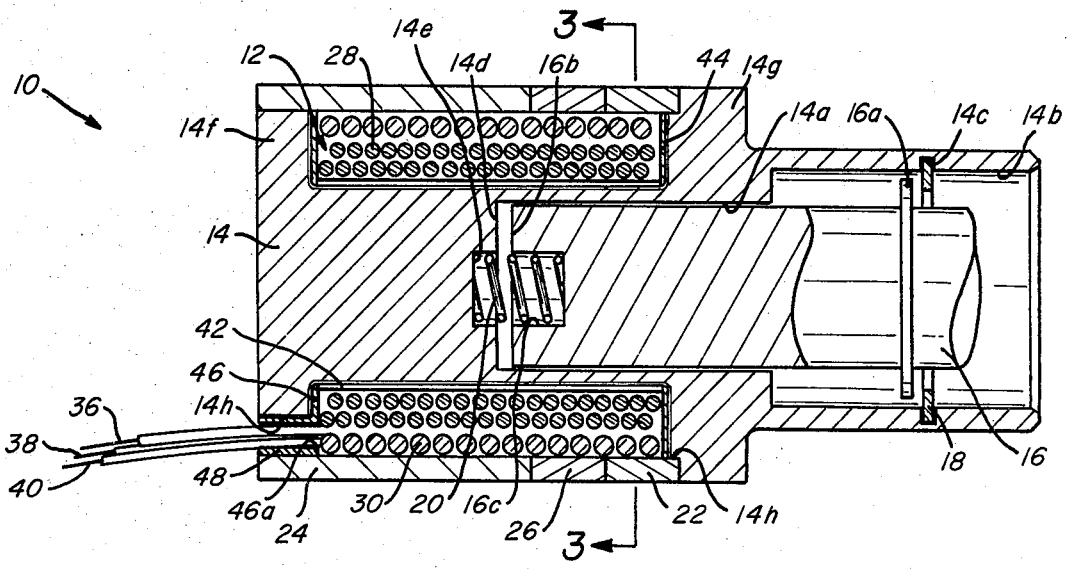
FIG. 1 is a horizontal elevation in partial section, and partly schematic, of a magnetically latching solenoid according to the present invention, showing the armature in an intermediate position.

A magnetically latching solenoid according to the present invention is shown generally at 10 in FIG. 1. A coil assembly shown generally at 12 is wound on a bobbin, or core, 14. An armature, or plunger, 16 is received within a first cylindrical bore segment 14*a* of the bobbin 14 so as to be movable along the cylindrical axis of the bobbin. The armature 16 extends into a second cylindrical bore segment 14*b* which is adjacent to and axially coincidental with the first bore segment 14*a*. The second bore segment 14*b* is of greater transverse cross-section than the first bore segment 14*a* to accommodate an annular flange 16*a* circumscribing the shaft of the armature 16. A snap ring 18 is held within an annular groove 14*c* extending into the interior wall of the second bore segment 14*b* to limit movement of the flange 16*a* and, therefore, the armature toward the open end of the second bobbin bore segment.

The first bobbin bore segment 14*a* ends at an annular surface 14*d* which surrounds the mouth of a relatively shallow, third cylindrical bore segment 14*e* in the bobbin, also axially coincidental with the first bore segment. Facing the bobbin surface 14*d* is the armature end surface 16*b* which surrounds the mouth of a cylindrical, axial armature bore 16*c*. With the armature 16 so received by the first and second bobbin bore segments 14*a* and 14*b*, respectively, the two bores 14*e* and 16*c* are mutually axially aligned to confine a coil spring 20 which biases the armature away from the bobbin surface 14*d*. It will be appreciated that, with the snap ring 18 positioned as shown, the armature 16 is generally movable longitudinally along the axis of the bobbin 14 between a first extreme position to the right, as viewed in FIG. 1, in which the annular armature flange 16*a* is stopped by the snap ring, and a second extreme position to the left, as viewed in FIG. 1, in which the armature end surface 16*b* is stopped by the bobbin surface 14*d*. Further, the armature 16 is spring-biased toward the aforementioned first position.

The coil assembly 12 is constructed, in a manner described hereinafter, about the longitudinal neck of the bobbin 14 between two external annular bobbin flanges 14*f* and 14*g*. A first sleeve 22 and an axially longer second sleeve 24 are positioned at axially opposite sides of a permanent magnet 26 in the form of a ring which cooperates with the two sleeves to enclose the coil assembly 12. The transverse diameter of the bobbin flange 14*f* is sufficiently small to allow the sleeves 22 and 24 and the permanent magnet 26 to be mounted on the solenoid by being passed over the flange 14*f*. The bobbin flange 14*g* provides a stop for the first sleeve, and a shoulder 14*h* to align the sleeve 22 with its cylindrical axis coincidental with that of the bobbin 14.

Figure 2:
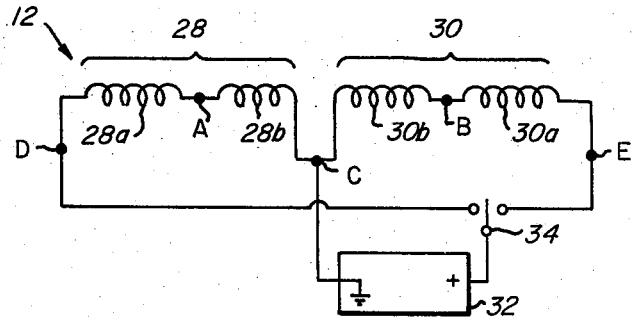
FIG. 2 is a schematic wiring diagram illustrating the coil assembly of the solenoid of FIG. 1.

As may be appreciated by reference to FIG. 2, the coil assembly 12 includes two coil subassemblies 28 and 30. Subassembly 28 comprises a coil including two coiled wire segments 28*a* and 28*b* electrically connected in series at a point A. Similarly, subassembly 30 comprises a coil including two coiled wire segments 30*a* and 30*b* electrically connected in series at a point B. The two segments 28*b* and 30*b* are electrically joined at a point C. The coil assembly 12 is bounded by terminal points D and E.

Point C of the coil assembly 12 is electrically connected by an appropriate lead to the common terminal of a small dc power supply 32. The coil terminal points D and E are connected by appropriate leads to the two end terminals of a single pole, triple throw switch 34, whose pole is connected to the positive terminal of the power source 32. The middle switch terminal is unconnected, or neutral. By appropriate manipulation of the switch 34, a small dc voltage may be selectively applied across either coil subassembly 28 or 30. With the switch 34 in the neutral position, however, the electrical circuit through the coil assembly 12 is open, and no current flows through either of the coil subassemblies 28 or 30.

With both coil subassemblies 28 and 30 wound on the bobbin 14 in the same rotational sense, a solenoid configuation is achieved whereby current flow may be selectively directed in either rotational sense about the bobbin by selective operation of the switch 34. Thus, for example, a solenoid magnetic field may be generated with the field directed along the cylindrical axis of the bobbin to the left as viewed in FIG. 1 by closing the switch 34 to place the power supply 32 across the coil subassembly 28. In that case, reversing the position of the switch 34 to place the power supply across the coil subassembly 30 generates a magnetic field generally in the opposite direction along the bobbin axis.

The ring magnet 26 is magnetized axially, that is, the field of the permanent magnet is similar to that of a solenoid, with the field lines within the inner surface of the ring oriented generally along the cylindrical axis of the ring. The permanent magnet 26 is oriented on the bobbin 14 so that the field of the permanent magnet along its cylindrical axis is directed in the same sense as the magnetic field produced along the bobbin axis by current flowing through the coil subassembly 28. Then, current flowing in the coil subassembly 30 generates a magnetic field whose axial directional sense is opposite that of the field of the ring magnet 26.

The bobbin 14, the armature 16, and the sleeves 22 and 24 may all be constructed of high purity iron, such as Armco mag-iron, exhibiting relatively high permeability. These elements are included in the magnetic circuit of both the coil assembly 12 and the permanent magnet 26, and conduct almost all of the flux of the respective magnetic fields.

The permanent magnet 26 may be constructed of a ring of magnetic material such as one of the aluminum-nickel-cobalt-steel alloys known as Alnico. As is well known, such alloys exhibit sufficient retentivity, reminisence and coercive force to serve as good permanent magnet material. The ring magnet 26 may be magnetized in an external field after the solenoid 10 is assembled. The relatively soft iron magnetic circuit elements 14, 16, 22 and 24 exhibit little or no residual magnetism after exposure to such an external magnetic field. Alternatively, the ring magnet 26 may be separately exposed to a magnetizing field and then positioned on the solenoid 10.

As discussed hereinbefore, the armature 16 is provided with a limited amount of freedom of longitudinal movement between a first position limited by the snap ring 18 and a second position limited by the bobbin surface 14*d*. Such freedom of movement is subject to the biasing by the spring 20 of the armature 16 towards the snap ring 18.

It is well known that a ferromagnetic plunger, such as the armature 16, tends to be drawn into the interior of a solenoid-type magnetic field. Barring obstructions or other external forces, the net force of the solenoid magnetic field on the plunger becomes zero only when the magnetic centers of the solenoid field and that of the field induced in the plunger coincide. By applying these principles to the present invention, as illustrated in FIG. 1, it will be appreciated that the field of the permanent magnet 26, acting by itself, tends to draw the armature 16 to the left, thereby urging the center of the armature toward the center of the magnet 26. Similarly, the field generated by either one of the coil subassemblies 28 or 30 acting alone would tend to move the armature 16 to the left as viewed in FIG. 1 thereby also urging the center of the armature toward the center of the respective coil subassembly. The operation of the spring 20, however, resists such movement by the armature 16.

The field strength of the ring magnet 26 and the force constant of the spring 20 are predetermined so that the field of the permanent magnet, acting by itself, is of insufficient strength to move the armature 16 against the spring and away from the first position with the flange 16*a* against the snap ring 18. However, once the armature 16 has been located in the second position against the annular bobbin surface 14*d*, and with the armature as a whole positioned generally closer to the center of the permanent magnet field, the increased magnetic force acting on the armature to the left as viewed in FIG. 1 is sufficient to hold the armature stationery and maintain the spring 20 compressed. In this way, the permanent magnet 26 latches the armature 16 in place in the second position. A substantial increase in the size of the force of the permanent magnet field acting on the armature 16 in the second position as compared to the corresponding force of the permanent magnet acting on the armature in the first position is due to the magnetic pulling force on the armature depending on the inverse square of the distance between the armature and the center of the magnetic field, as is well known. Thus, although the longitudinal movement of the armature 16 between its first and second positions may only be as small as 0.24 cm., the difference in the force of the permanent magnet field on the armature in these two positions is significant compared to the force constant of the spring 20, though the latter is further compressed with the armature in the second position.

The coil subassembly 28 is utilized to generate a magnetic field of sufficient strength to move the armature 16 from its first position to its second position against the biasing of the spring 20. The physical specifications of the subassembly 28 as well as the power capability of the power supply 32 are predetermined to selectively produce the necessary force to so move the armature 16. Thus, for example, a sufficient number of turns must be included in the coil subassembly 28, in consideration of the power available from the source 32, to provide the necessary ampere-turns to produce the force to overcome the spring biasing. Once the armature 16 has been moved to its second position under the influence of the magnetic field generated by the current flowing through the coil subassembly 28, the force acting on the armature due to the magnetic field only of the permanent magnet 26 is sufficient to hold the armature latched in that second position. Then, the current flowing through the coil subassembly 28 may be interrupted by repositioning of the switch 34 at its neutral position. The coil subassembly 28 is referred to as the "pull-in" coil because of its function in pulling the armature 16 further within the permanent magnet 26.

The armature 16 may be delatched from its second position wherein it is held by the operation of the magnetic field of the ring magnet 26. This delatching may be effected by the generation of the magnetic field of the other coil subassembly 30. As noted hereinbefore, throwing the switch 34 to place the power supply 32 across the coil subassembly 30 produces a magnetic field directed along the bobbin axis oppositely to that of the permanent magnet 26. When this is done, the field of the permanent magnet 26 within the volume occupied by the armature 16 is temporarily, and at least partially, nullified by the field of the coil subassembly 30 directed in the opposite sense. With the net magnetic force on the armature 16 at or near zero, the biasing spring 20 moves the armature to its first position against the snap ring 18. The switch 34 may then be returned to its neutral position to interrupt the flow of current through the coil subassembly 30. Because of its function in releasing the armature 16 from the latching influence of the permanent magnet 26, the coil subassembly 30 is referred to as the "delatching" coil.

Since the magnitude of a magnetic field generated by a current-carrying solenoid is, at any point in the field, proportional to the ampere-turns of the solenoid, it will be appreciated that, for a given power source 32, the number of turns in the delatching coil 30 must generally be less than the number of turns in the pull-in coil 28. This relative reduction in the delatching coil turns is required so that generation of the delatching coil field, which is generally in opposition to that of the ring magnet 26, does not demagnetize the ring magnet. However, the strength of the pull-in coil field must be sufficient to overcome the biasing of the spring 20. Therefore, more turns are generally needed in the pull-in coil 28. In a typical case, for example, the number of turns in the pull-in coil 28 may be, say, 1,165, while the delatching coil 30 has only about 295 turns. Thus, to accommodate the increased number of pull-in coil turns while maintaining the overall size of the solenoid 10 at a minimum, the pull-in coil 28 is wound on the inside of the coil assembly 12, and the delatching coil 30 is constructed around the pull-in coil. Additionally, the pull-in coil 28 may be constructed of wiring whose thickness is generally smaller than the wiring used to construct the delatching coil 30. The relative positions and thickness of the coil subassemblies 28 and 30 are indicated generally in FIG. 1.

Material of good electrical conductivity, such as copper, may be utilized in constructing each of the coil subassemblies 28 and 30. However, in the case of each such coil subassembly, a segment of wiring is included that is constructed from material featuring relatively low temperature coefficient of resistivity. Thus, the pull-in coil 28 includes, for example, the coiled wire segment **28*a* of copper wire, and the coiled wire segment 28*b* constructed to alloy 90, for example, an alloy of 90% copper and 10% nickel. Alloy 90 also features a higher resistivity than copper. Similarly, the delatching coil 30 includes, for example, the coiled wire segment 30*a* constructed of copper wire and the coiled wire segment 30*b* constructed of alloy 90 wire. In each case, since the two coiled wire segments of a coil subassembly are in series, the alloy 90 wiring segment insures that the total resistivity of the subassembly remains within a preselected range of values over a relatively broad temperature range, particularly in the cryogenic region. At the same time, the copper wire segment of each subassembly provides the majority of the coil turns at a resistivity lower than that of the alloy 90**.

The length and therefore, the number of turns of each of the coiled wire segments **28*a*, 28*b* and 30*a*, 30*b* may be preselected in view of the output voltage of the power supply 32 to insure that the total resistance of the pull-in coil 28 as well as that of the delatching coil 30, at cryogenic temperatures, remains sufficiently high to avoid drawing excessive current from the power supply to either damage the power supply and/or, for example, diminishing the strength of the magnetic field of the ring magnet 26 in the delatching operation. Such construction of the coil assembly 12** also avoids the necessity of adjusting the power supply output for various temperature values.

In a typical case, the copper segment **28*a* of the pull-in coil may include, for example, 1,110 turns while the alloy 90 segment 28*b* may include 55 turns. Similarly, the copper segments 30 of the delatching coil 30 may include, for example, 200 turns while the alloy 90 segment 30*b* may include 95 turns. With the power supply output at approximately 22 volts, the current drawn by the coil assembly in either the pull-in mode or the delatching mode may range from, for example, 2 amperes at −250° F. to 5 amperes at −420° F. By contrast, with the coil assembly 12** constructed entirely of copper wire, the current might be expected to rise sufficiently to destroy the power supply circuitry as the coil resistance approaches zero at the low temperature limit.

To avoid incorporating too high a resistance in each of the coil subassemblies 28 and 30, the coiled wire segment of the higher resistance in each subassembly, that is, the segment constructed of the alloy 90 wire, may be positioned to the inside of the corresponding copper coiled wire segment. Details of the manner of winding the coiled wire segments to construct the coil assembly 12 may be appreciated by reference to FIGS. 2 and 3.

Figure 3:
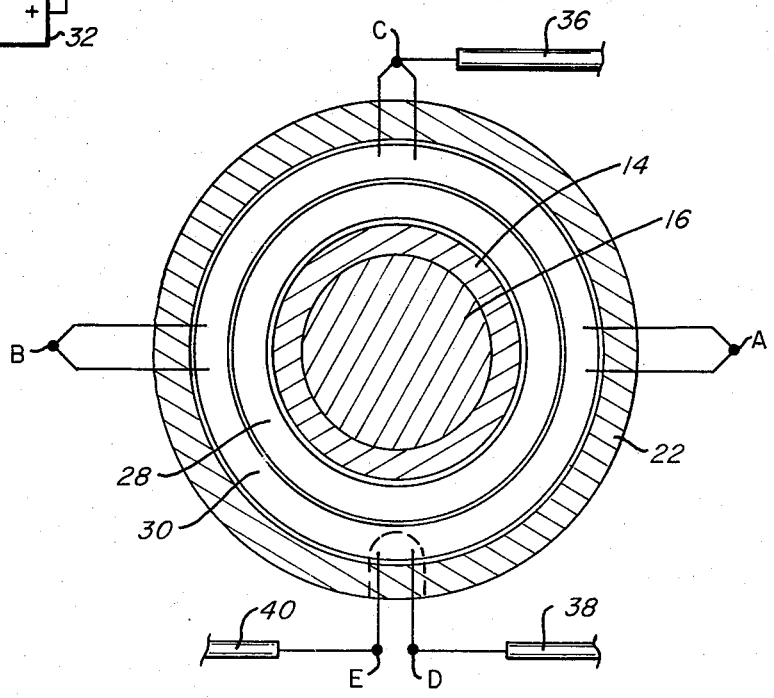
FIG. 3 is a transverse cross section, taken along line 3—3 in FIG. 1, with schematic wire connection diagrams superimposed.

Each coiled wire segment **28*a*, 28*b*, 30*a*, and 30*b* may be wound on the bobbin 14 individually, with appropriate leads left exposed and extending beyond the coil segment. After all coiled segments have been wound on the bobbin, the appropriate lead lines are joined by, for example, solder joints. Thus, the higher resistivity coiled wire segment 28*b* may be wound on the bobbin first followed by the relatively lower resistivity segment 28*a* to complete the winding of the pull-in coil 28. Then, the higher resistivity coiled wire segment 30*b* of the delatching coil 30 may be wound over the pull-in coil 28, followed by the copper wire segment 30*a* to complete the winding of the delatching coil. With all of the leads of the coiled wire segments extending outwardly from the windings, appropriate solder connections may be made to electrically connect the various coiled wire segments as indicated in FIGS. 2 and 3. Thus, for example, as shown in FIG. 3 the connection at point C between the two alloy 90 wire segments 28*b* and 30*b* is made and joined to a cable, or other connector, 36 which is ultimately connected to the common terminal of the power supply 32 (FIG. 2). Similarly, the terminal points D and E from the pull-in coil 28 and the delatching coil 30, respectively, are joined to connectors 38 and 40 leading to appropriate terminals of the switch 34 as shown in FIG. 2. Within each coil subassembly 28 and 30, the coiled wire segments are connected in series by solder joints as at A and B. The individual coil leads may then be positioned against the windings to accommodate enclosing the coil assembly 12 within the sleeves 22 and 24 and the ring magnet 26**.

With the connections between the coiled wire segments positioned external to the coil windings, and provided with lead lines of sufficient length, none of the wire joints is subject to thermal stress. Thus, as the coil wiring experiences contraction and extension with temperature change, the lead lines to the solder joints are sufficiently long to flex and bend as required to avoid the possibility of shorts or breaks that might result if such joints were stressed.

All of the wiring of the coil assembly 12 is insulator-coated with appropriate electrically insulating material, such as enamel and silicone varnish. The solder joints may be similarly coated after having been completed. The neck of the bobbin 14 as well as the interior surfaces of the flanges **14*f* and 14*g* are lined with an electrically insulating material 42 and annular spacers 44 and 46 are positioned against the flanges before the coil assembly 12 is wound on the bobbin. An appropriate hole 46*a* in the spacer 46, and a groove 14*h* in the flange 14*f* accommodate the passage of the connectors 36, 38 and 40 from the coil assembly 12 to the exterior of the bobbin 14. The groove 14***h* in the bobbin flange 14*f* and the spacer hole 46*a* are lined with a protective sleeve 48. Each of the connectors 36, 38 and 40 may also be coated with an appropriate insulator and covered with a protective sleeve.

Figure 4:
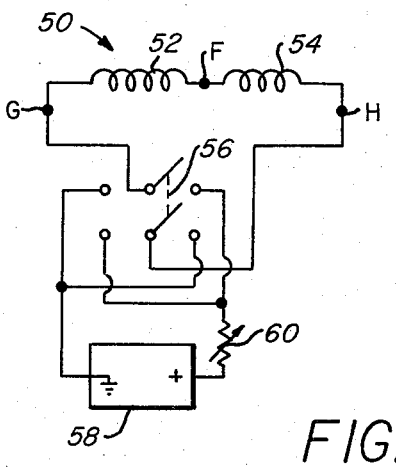
FIG. 4 is a schematic wiring diagram showing an alternate coil assembly.

An alternate wiring scheme for a magnetically latching solenoid according to the present invention is illustrated in FIG. 4. A coil assembly shown generally at 50 includes a coiled wire segment 52 connected in series with a second coiled wire segment 54. The two coil segments 52 and 54 are joined at a solder connection F. The coil assembly 50 is bounded by terminal points G and H which are joined, by solder joints, to appropriate connectors leading to the center terminals of a double pole, triple throw switch 56. Each pair of the end terminals of the switch 56 are joined by appropriate connectors in series with a power supply 58 and a variable resistor 60 as may be readily appreciated from FIG. 4. The effect of throwing the switch 56 to close on one pair of its end terminals or the other is to cause current to flow in one direction or the other through the coil assembly 50. Placing the switch 56 in the neutral, or center, position opens the circuit including the coil assembly 50 to prevent current flow.

The coiled wire segment 52 is constructed of material of good electrical conductivity, such as copper. The coiled wire segment 54 is constructed of wiring material, such as alloy 90, featuring relatively low temperature coefficient of resistivity, and generally higher resistivity. Consequently, the resistance of the coil assembly 50 will remain sufficiently high at cryogenic temperatures to avoid drawing excessive currents from the power supply 58. The coil assembly 50 is wound on a bobbin such as 14 in the same manner as in the case of the coil assembly 12, as described hereinbefore. However, only two coiled wire segments 52 and 54 are included in the coil assembly 50. The higher resistivity coiled wire segment 54 is wound on the bobbin first, followed by the coiled wire assembly 52. The solder connections are made at points F, G, and H after the winding of the coil wiring is complete. The remainder of the construction of the solenoid utilizing the wiring scheme of FIG. 4 may be the same as that of the solenoid illustrated in FIGS. 1–3.

In the operation of the solenoid according to FIG. 4, the coil assembly 50 serves as both the pull-in coil and the delatching coil. The particular mode of operation is selected by appropriately positioning the switch 56 to permit flow of current in one direction or the other through the coil assembly 50 to increase the magnetic field within the armature 16 in the direction of the field of the ring magnet 26 (pull-in mode), or to generate a magnetic field within the armature in the direction opposite that of the field of the ring magnet (delatching mode). The variable resistor 60 may be appropriately adjusted to provide sufficient current in the pull-in mode to generate force to overcome the operation of the biasing spring 20, and to lower the current value utilized in the delatching mode to prevent diminishing the field of the ring magnet 26. A switch may be incorporated in the variable resistor 60, or connected in series therewith, to open the circuit from the power supply 58 when no current flow through the coil assembly 50 is desired. Then, a double throw switch may be utilized in place of the triple throw switch 56.

It will be appreciated that a magnetically latching solenoid according to the present invention may be utilized in many different applications. For example, the armature 16 may be joined to a controlling mechanism to open and close a valve. With the capability of reliable operation at extremely low temperatures, the present invention may be thus employed to control the flow of cryogenic fluids. In other applications, the armature 16 may be used to operate the opening and closing of a switch in a high power circuit, in the manner of a relay. However, the solenoid according to the present invention may be employed in extreme low temperature environments.

The present invention provides a magnetically latching solenoid of compact design, but of sturdy and reliable construction with no thermal stress affecting the electrical connections of the coil assembly. The two-wire construction of the solenoid coil according to the present invention, including wiring material of low temperature coefficient of resistivity, ensures that the total resistance of the solenoid coil, in either the pull-in operating mode or the delatching operating mode, will never be zero, nor sufficiently low to draw excessive currents from the power circuit.

The foregoing disclosure and description of the invention is illustrative and explanatory thereof, and various changes in the method steps as well as in the details of the illustrated apparatus may be made within the scope of the appended claims without departing from the spirit of the invention.

What is claimed is:

1. Magnetically operable apparatus capable of operating in cryogenic environment comprising:

(a) plunger means, including magnetically responsive material, movable generally along a path between a first position and a second position;

(b) coil means generally circumscribing at least a portion of said path and positioned so that the center of said magnetically responsive material of said plunger means moves generally toward the center of said coil means as said plunger means moves toward said second position;

(c) a first coil segment, as part of said coil means, constructed of electrically conducting material; and (d) a second coil segment, as part of said coil means, electrically connected in sequence with said first coil segment, and constructed of electrically conducting material with a temperature coefficient of resistivity lower than that of said first coil segment and (e) the total resistance of the coil means remaining nonzero for all values of the temperature of the environment within which the apparatus is to be operated.

2. Apparatus as defined in claim 1 further comprising latch means for maintaining said plunger means in said second position.

3. Apparatus as defined in claim 2 or, in the alternative, as defined in claim 1 further comprising spring means biasing said plunger means toward said first position.

4. Apparatus as defined in claim 1 further comprising electrical power means for selectively generating electric current in said coil means in one sense or the other to produce magnetic fields to act on said plunger means.

5. Magnetically operable solenoid apparatus capable of operation in cryogenic temperature comprising:

(a) plunger means, including magnetically responsive material, constrained to movement along a path between a first position and a second position;

(b) means for biasing said plunger means toward said first position;

(c) magnetic latching means for providing a magnetic field to operate on said plunger means to latch said plunger means in said second position;

(d) a coil assembly generally circumscribing at least a portion of said path and positioned so that the center of the magnetically responsive material of said plunger means moves generally toward the center of said coil assembly as said plunger means moves toward said second position;

(e) first and second coil subassemblies as parts of said coil assembly positioned so that current flow through said first coil assembly generates a solenoid magnetic field operating on said plunger means to move said plunger means toward said second position; and so that current flow through said second coil assembly generates a solenoid magnetic field operating in opposition to the magnetic field of said magnetic latching means to permit said biasing means to move said plunger means toward said first position;

(f) said first coil subassembly comprising one coil segment of electrically conducting material, and another coil segment of electrically conducting material with a temperature coefficient of resistivity lower than that of said one coil segment whereby the total resistance of the first coil subassembly during operation in the cryogenic temperature range will limit the drawing of excessive current; and (g) said second coil subassembly comprising one coil segment of electrically conducting material, and another coil segment of electrically conducting material with a temperature coefficient of resistivity lower than that of said one coil segment of said second coil subassembly whereby the total resistance of the second coil subassembly during operation in the cryogenic temperature range will limit the drawing of excessive current.

6. Apparatus as defined in claim 5 wherein the material for one of the coil segments is formed from Alloy 90.

7. Apparatus as defined in claim 5 further comprising bobbin means for supporting said coil assembly.

8. Apparatus as defined in claim 5 wherein said magnetic latching means comprises a permanent ring magnet generally circumscribing at least a portion of said path and positioned relative to said first and second positions such that the strength of the magnetic field is large enough to latch said plunger means in said second position, but is not large enough to move said plunger means from said first position to said second position against said biasing means.

9. A method of operating in a cyrogenic environment on a plunger constrained to movement along a path between a first position and a second position and biased toward said first position, comprising the following steps:

(a) providing an electromagnet comprising two coiled wire segments in series, with one such segment constructed of material of relatively low temperature coefficient of resistivity with the total resistance remaining nonzero for all values of the temperature of the environment;

(b) providing a permanent magnetic latching means to latch said plunger in said second position; and (c) selectively applying electric power to said electromagnet in one sense to generate a magnetic field to move said plunger toward said second position, or in the opposite sense to generate a magenetic field to at least partially nullify the field of said magnetic latching means to permit said plunger to move toward said first position without diminishing the strength of the permanent magnet.

10. Apparatus as defined in claim 4 wherein the material for the second coil is Alloy 90.

11. Apparatus as defined in claim 8 wherein the strength of the second coil subassembly is large enough to sufficiently nullify the effect of the permanent magnet yet sufficiently small to avoid diminishing the strength of the permanent magnet.

12. Apparatus as defined in claim 11 wherein the material for one of the coil segments is formed from Alloy 90.

* * * * *